US005231804A

United States Patent [19]

Abbott

[11] Patent Number: 5,231,804

[45] Date of Patent: Aug. 3, 1993

[54] HOSE CLEANING SYSTEM

[75] Inventor: Kenneth E. Abbott, Tucson, Ariz.

[73] Assignee: Stripping Technologies Inc., Tucson, Ariz.

[21] Appl. No.: 730,434

[22] Filed: Jul. 16, 1991

Related U.S. Application Data

[63] Continuation-in-part of Ser. No. 504,907, Apr. 3, 1990, abandoned.

[51] Int. Cl.[5] ..... B24C 3/02

[52] U.S. Cl. ..... 51/411; 51/420

[58] Field of Search ..... 51/411, 410, 424, 425, 51/319, 320, 420

[56] References Cited

U.S. PATENT DOCUMENTS

| | | | |
|---|---|---|---|
| 2,451,635 | 10/1948 | Schratt | 51/420 |
| 2,692,458 | 10/1954 | Lawrence | 51/411 |
| 3,151,418 | 10/1964 | Powell et al. | 51/411 |
| 3,485,671 | 12/1969 | Stephens | 51/411 |
| 3,523,391 | 8/1970 | Levinson et al. | 51/411 |
| 3,835,587 | 9/1974 | Hall, Jr. | 51/411 |
| 4,827,678 | 5/1989 | MacMillan et al. | 51/320 |

FOREIGN PATENT DOCUMENTS

| | | | |
|---|---|---|---|
| 0036396 | 3/1977 | Japan | 51/411 |
| 0263671 | 12/1985 | Japan | 51/411 |

*Primary Examiner*—Robert A. Rose
*Attorney, Agent, or Firm*—Ogram & Teplitz

[57] ABSTRACT

The interior of a hose is cleaned of debris using an abrasive blast head which is inserted through the length of the hose while the hose is rotated through its longitudial axis. An air cleaner/filtration device draws spent media and removed debris from the hose during the cleaning operation and separates the two.

25 Claims, 2 Drawing Sheets

HOSE CLEANING SYSTEM tion Ser. No. 07/504,907, filed Apr. 3, 1990, and entitled "Improved Air Filtration/Recovery System" now abandoned.

BACKGROUND OF THE INVENTION

This invention relates generally to abrasive blasting and more particularly to a mechanism for cleaning debris from confined areas.

Heavy industry requires the transportation of countless different chemicals, paints, petroleum products, and other liquids. The containers used for this transportation build up residue which must be periodically removed.

Into this application has come abrasive blasting, either sand blasting or its newer cousin, plastic media blasting. Both are very useful for cleaning containers. Typically the residue is less dense then the container substrate and a thorough cleaning can be easily and quickly performed. In using abrasive blasting, an operator typically enters the container (e.g. a railroad tank car or semi-truck tanker) and proceeds to remove the residue.

Within this discussion, the abrasive used is plastic media which is under moderate pressure to abrade unwanted material from the substrate. Those of ordinary skill in the art readily recognize that the present invention is equally applicable to other pressurized abrasive techniques, irregardless of the type of abrasive media used, and is not limited to, plastic, sand, and water blasting.

Because of the close confines of the container, two considerations play an important role in utilizing abrasive blasting for the cleaning:

(i) Ventilation—Requires that proper air flow be established to remove air-suspended dust so that an operator can see the substrate being cleaned; and, (ii) Media Recovery—The removal of used abrasive and debris in an organized manner.

To this end, one set of developments have sought to design specialty blast rooms. Examples of such rooms are described in: U.S. Pat. No. 2,912,918, entitled "Blast Room with Uniform Down-Draft Ventilation" issued to Mead on Nov. 17, 1959; U.S. Pat. No. 4,297,940, entitled "Protective Workplace and System" issued to Hainline on Nov. 3, 1981; and U.S. Pat. No. 3,863,392, entitled "Sand Blast Room" issued to Haker on Feb. 4, 1975. All of these references are incorporated hereinto by reference.

In all of these applications, the media recovery systems are outside the container and therefore unusable.

Because there is a lack of devices to address these problems, many operators of abrasive blasting systems for containers manually sweep up the media and shovel the media into buckets for removal from the container through the top opening. The buckets are then deposited into a standard media recovery hopper.

It is clear that this approach is both inefficient and time consuming.

Ventilation for a container abrasive blasting situation is usually accomplished by attaching the standard air cleaning system as described in several of the above referenced patents to an existing exhaust port located at the top of the container. In this manner, air is pulled through a top portal into the container and then through the exhaust port at the top of the container.

This arrangement completely ignores the media recovery problems discussed earlier.

Recovery of debris and media within a container poses difficult problems because of size considerations. These problems are magnified when debris must be cleaned from hoses (usually two to three inches in diameter) which are used to drain these containers.

The current state-of-the art approach to this problem is to soak the hoses in solvents and flush. The use of solvents poses a significant amount of environmental problems. Because of the cost of the solvents and associated problems in the disposal of the solvent/debris mixture, often these hoses are simply discarded.

The discarding of hoses is expensive.

It is clear from the foregoing that an efficient mechanism for the cleaning of hoses and the recovery of media does not exist.

SUMMARY OF THE INVENTION

In the present invention, an abrasive blasting head is passed through the entire length of the hose while the hose is being rotated around it's longitudial axis. Through proper control of the speed of inserting the blast lance together with rotation of the hose, a thorough cleaning of the entire interior surface is achieved.

An added feature of the invention is the use of a cleaning hopper which is attached to one end of the hose. As the blasting lance is inserted into the hose, air is drawn through the hose carrying the debris and spent media into the cleaning hopper.

In one embodiment of the invention, a movable housing or container encompasses a portion of the hose. Within this container is a second or exterior blast nozzle that cleans the outside of the hose.

The container and interior blast lance are mechanically controlled so as to maintain their fixed relationship. As the interior lance passes through the hose, the exterior blast head passes over the exterior of the hose. In this manner, both the interior and the exterior of the hose are simultaneously cleaned.

The cleaning hopper of the present invention is instrumental both for container cleaning and also for hose cleaning.

Container Cleaning

The mixture is passed into a hopper having a screen to remove the larger particles. The partially cleaned media and air is then pulled to a cyclone separator for a final cleaning.

In this fashion, the hopper serves two functions: (i) media retrieval; and (ii) ventilation.

For ventilation during the blasting operation, external air which is used for ventilation of the container during the blasting operation is drawn in through an open port usually located at the top of the container. This air travels through the container, intermixing with the fouled air, and exits through the gravity fed exit port located at the bottom of the container.

In operation, from the gravity fed exit port of the container, the air-media mixture is directed, usually by a pipe or duct, to an enclosed hopper. A typical gravity fed exit port has a three inch diameter which is more than sufficient for the required air flow.

The enclosed hopper directs the air-media mixture over a screen which removes large particles and debri such as tape or large paint flakes. The partially cleaned air-media mixture passes through an output port preferably in the side of the hopper and on to conventional cleaning apparatus well known to those of ordinary skill in the art.

For media recovery, when the operator wishes to remove media from inside the container, he simply sweeps the media into the container's exit port and the system pneumatically conveys it through the same hopper for cleaning/recovery.

As example, once the blasting is completed, or when the operator wishes to remove some of the accumulated spent media, the system operates in the same identical manner as when the system was performing the ventilation operation.

That is, the spent media is swept to the gravity fed exit port where it is "sucked" by the air flow therethrough. The media enters into the top of the hopper. Again the screen removes large particles permitting the partially cleaned media to pass onto the traditional media cleaning equipment.

In this manner, the operator within the container does not have to leave the container to adjust any valves or switch external operations. Rather, the operator is permitted to abrasively blast until he desires to cleanup and then do the cleanup operation without leaving the container or altering the external equipment.

In one embodiment of the invention, clogging of media within the hopper is prevented through the use of an air passage which permits external air to be drawn into the output port of the hopper. This permits a minimum air supply to the traditional media cleaning apparatus. A "slug" of media is thereby prevented from clogging the output port of the hopper and assures that a minimal air flow is maintained.

In another embodiment of the invention, the hopper serves the dual function as described above but also acts as a traditional hopper. This operation usually is done to recover media that has fallen on the floor either through accident or as a result of abrasive blasting of the exterior of the container.

In this embodiment, the top of the hopper is removable permitting media to be shoveled directly into the hopper. A secondary output port on the hopper has a smaller diameter and permits the media to "trickle" into an air stream and on to traditional media cleaning equipment. Hose Cleaning:

The hopper of the present invention also works to assist in hose cleaning.

Air, drawing the spent media and debris from the interior of the hose, is pulled into the hopper which operates exactly as described before; except that one end of the hose is rotatably attached to the input port of the hopper.

The air flow through the hose keeps spent media and debris from collecting in the hose and handicapping the cleaning process.

The invention, together with various embodiments thereof will be more fully described by the following drawings and their associated descriptions.

DRAWINGS IN BRIEF

DRAWINGS IN DETAIL

Figure 1:
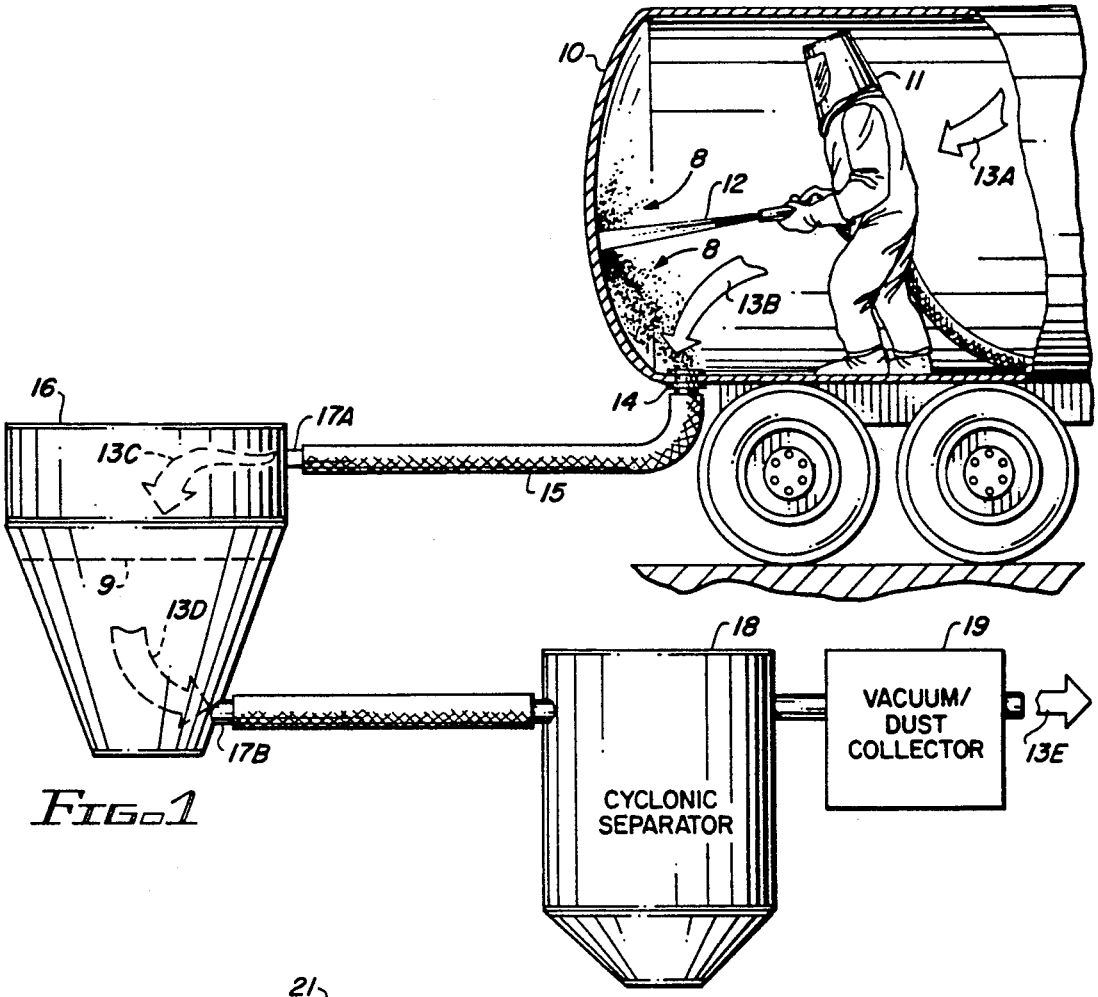
FIG. 1 is a side view of an embodiment of the invention illustrating the dual purpose of the hopper.

FIG. 1 is a cut-away view of the preferred embodiment of the invention illustrating the interaction between container 10, hopper 16, and the traditional cleaning mechanism of cyclone separator 18 and vacuum/dust collector 19.

Operator 11 utilizes abrasive blast spray 12 to clean the interior of container 10 creating spent media and debris 8. Air flow 13A maintains the visibility for operator 11 to perform the task at hand. Air flow 13A is created ultimately by vacuum/dust collector 19. Air flow 13A is external air drawn through a top portal on container 10 (not shown).

Debris 8 falls onto the floor of container 10 and via air flow 13B is sucked through gravity fed exit 14, through hose 15 and into hopper 16 via input port 17A.

The air debris mixture falls as indicated by air flow 13C over screen 9 which removes the large particles. The partially cleaned air-media mixture continues as indicated by air flow 13D through output port 17B and ultimately to cyclone separator 18 and vacuum/dust collector 19 where the cleaned air 13E exits the system.

As is well known in the art, cyclone separator 18 separates the reusable media from unusable fine media and dust.

Although the illustration indicates the use of a cyclone separator 18 and a vacuum/dust collector 19, those of ordinary skill in the art readily recognize that these serve only to clean the air-media mixture and also recognize other alternative mechanisms which will perform this same function.

In the above discussion, the amount of media entrained in the air stream is relatively minor and generally encompasses any air suspended particles and some particles which may be inadvertently "brushed" into the gravity fed exit 14. In the second mode of operation, operator 11 actually sweeps, shoves, or otherwise encourages large quantities of media and debris, which has collected on the floor of container 10, into gravity fed exit 14.

Even though the quantity of media and debris entering the system is greatly enlarged from the ventilation operation, the system is still capable of handling the added amount and automatically processes the media. The media-debri is sucked into gravity fed exit port 14 by air flow 13B. In this manner, the operator cleans and recovers the media without leaving container 10 or doing any adjustment to the mechanism.

Figure 2:
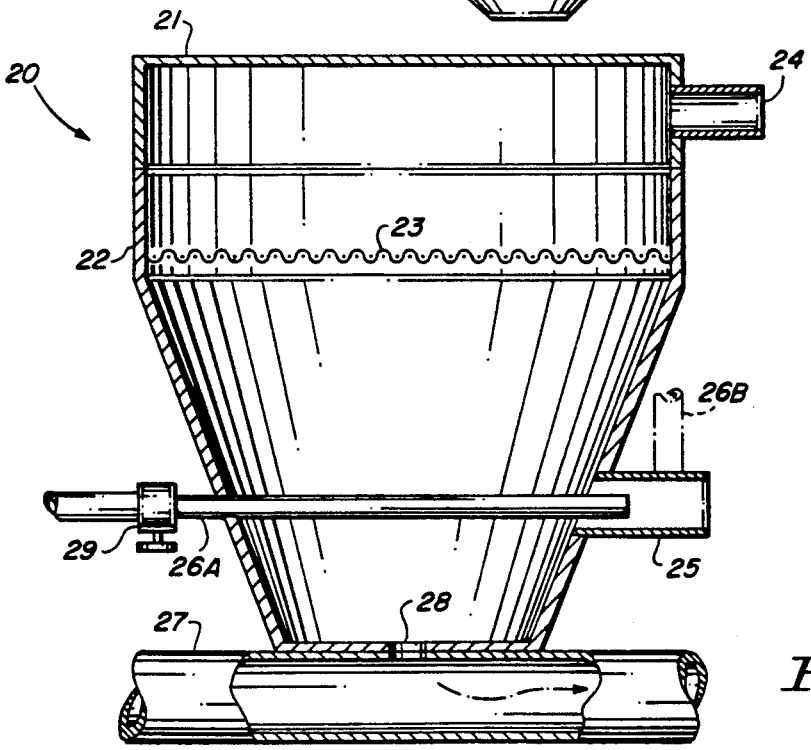
FIG. 2 is a cut-away view of an embodiment of the hopper.

FIG. 2 is a cut-away view of an embodiment of a hopper.

In this illustration, hopper 20 is composed substantially of lid 21 and main body 22. Lid 21 is removable permitting the operator to shovel or dump media directly into the hopper and not use the suction as indicated in FIG. 1. When lid 21 is placed on the main body 22, an enclosed hopper is created which maintains the vacuum from the dust collector, permitting the air-media, as discussed before, to enter via input port 24.

The air-media after entering through input port 24 falls across screen 23 which removes large particles and debris such as tape and paint chips. The partially cleaned air-media mixture passes through output port 25 and on to the cleaning mechanism (not shown).

In this embodiment of the invention, an air passage system is ensured via pipe 26A which extends from the exterior of hopper 20 into output port 25. Pipe 26A assures that a minimal supply of air is maintained to the cleaning mechanism (not shown) even if a "wad" of media were to dump over the opening of output port 25.

An alternative air passage system is illustrated by pipe 26B which serves the same function as pipe 26A. For pipe 26A, a valve is used to control the amount of air passing therethrough. A similar valve (not shown) is preferably mounted on pipe 26B for the same purpose. Those of ordinary skill in the art readily recognize several valves which will serve this function including, but not limited to a simple ball valve or a butterfly valve.

Orifice 28 permits media to trickle into an air stream established in pipe 27 by the cleaning mechanism of cyclone and vacuum/dust collector (not shown). The air stream in pipe 27 conveys the media to the cleaning mechanism (not shown). This arrangement of orifice 28 and pipe 27 is used when the operator dumps large amounts of media directly into hopper 20. During ventilation and media recovery operation, when output port 25 is utilized, orifice 28 is closed through the use of a plug or similar item.

This embodiment of the invention, as illustrated in FIG. 2, creates more efficient use of the operator's time since the room is ventilated and spent media is recovered using the same mechanism without any adjustment from the operator; yet, hopper 20 is still able to handle very large amounts of media being dumped into its top.

Figure 3:
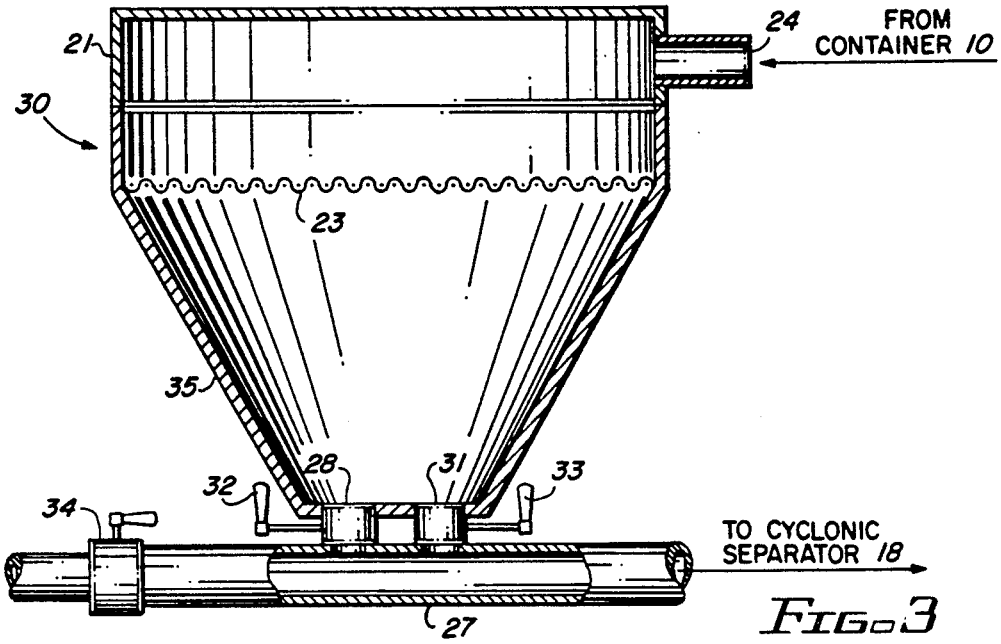
FIG. 3 is a cut-away view of an alternate embodiment of the hopper.

FIG. 3 is a cut-away view of another embodiment of the hopper. In this embodiment, the hopper is still composed substantially of lid 21 and main body 35.

Lid 21 serves the same function as described in FIG. 2, permitting air-media from container 10 to enter via input port 24 and enclosing hopper 30.

In this embodiment, main body 35 uses two openings in the bottom of hopper 30 for two different purposes. As before, orifice 28 still communicates with pipe 27 to handle a "dumping" of media into hopper 30. The second opening 31 is analogous to the opening used by output port 25 of FIG. 2. Opening 31 permits the air-media mixture to pass through to pipe 27 and then on to the cyclone 18.

Through selective control of valves 32, 33, and 34, the operator is able to create a hopper which serves the ventilation/media recovery operation, or alternatively processes bulk media dumped into the hopper.

For the ventilation/media recovery operation, valve 32 and valve 34 are closed. Valve 33 is opened to permit the air/media a clear flow into pipe 27 and on to cyclone 18. In one embodiment of the invention, valve 34 is not closed completely; this leave an air passage mechanism serving the same function as pipes 26A and 26B of FIG. 2.

For the processing of dumped media, valve 33 is closed and valves 32 and 34 are opened. This permits the dumped media to trickle into the air stream within pipe 27.

In this embodiment of the invention, valves 32, 33, and 34 are all butterfly type valves. Those of ordinary skill in the art readily recognize other valves which will serve this function such as but not limited to slide valves.

This embodiment of the invention is useful in permitting either the ventilation/media recover or bulk media cleaning.

Figure 4:
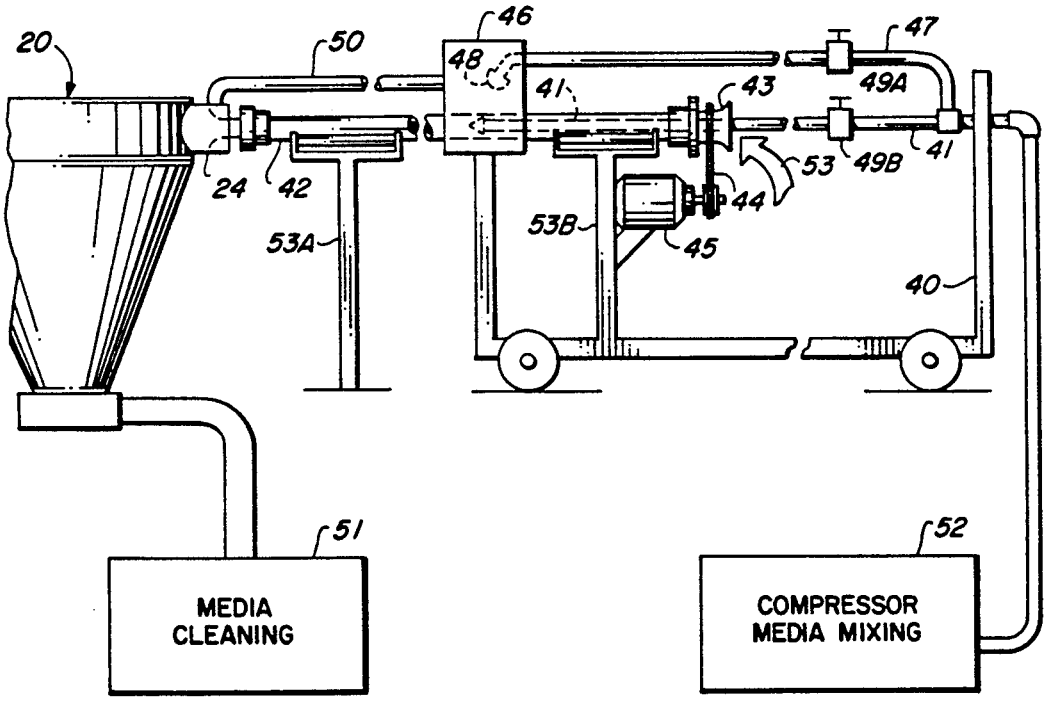
FIG. 4 is a functional layout of the hose cleaning apparatus.

FIG. 4 is a functional layout of an embodiment of the hose cleaning system.

Lance or interior blast hose 41 is inserted into hose 42 through collar 43. An air current, as illustrated by arrow 53, is created through hose 42 by the media cleaning apparatus 51 which draws the mixture through hopper 20. Hopper 20 and media cleaning apparatus 51 are well known in the art and have already been described in detail.

Interior blast hose 41 is supplied a mixture of media and compressed air from compressor and media mixing apparatus 52, both of which are well known in the art. The volume of mixture being used within hose 42 by interior blast hose 41 is controlled by valve 49B.

The operator, by pushing on carriage 40, inserts interior blast hose 41 into hose 42, cleaning as interior blast hose 41 progresses. Hose 42 is rotated around its longitudinal axis by motor 45 and chain 44 which attaches to collar 43.

This rotation of hose 42 removes the need to position the end of blast hose 41 equal distance from hose 42's walls. The rotation of hose 42 permits the entire interior to be addressed and cleaned. The end of interior blast hose 41 is permitted to sag and to a large extent, the end of interior blast hose 41 rests and rides on the lower portion of hose 42.

This aspect of the invention is important. No longer is there a need for a carriage that fits into the hose to maintain the hose equal distance from the walls of the hose. Without the need for an internal carriage, the problems of binding and travel restriction are eliminated.

Hose 42 is rotatably mounted on input port 24 of hopper 20. This permits the debris and spent media from hose 42 to be easily communicated for cleaning and separation by hopper 20 and media cleaning apparatus 51 during rotation of hose 42.

Carriage 40 also holds container 46 which encloses a portion of hose 42. Within container 46, nozzle 48 directs a flow of media and pressurized air against the exterior of hose 42. The media and compressed air to nozzle 48 is controlled by valve 49A in line 47.

The use of rubber seals or the like around the circumference of hose 42 keeps spent media and debris from falling from container 46. Exhaust line 50 communicates spent media and debris from container 46 to hopper 20 for separation and cleaning as discussed before.

Control of carriage 40 controls both the internal cleaning and the external cleaning since both are mechanically affixed to each other.

Brackets such as 53A and 53B support hose 42 and permit, through the use of rollers, the easy rotation of hose 42 by motor 45.

It is clear from the foregoing that the present invention creates a highly improved system for the cleaning of debri from the interior of hoses.

What is claimed is:

1. A hose cleaning system comprising:

a) a vacuum source being rotatably attached to a first end of the hose;

b) rotational means for rotating the hose around its longitudinal axis;

c) interior abrasive blasting means being insertable into said second end of said hose;

d) container means for surrounding an exterior portion of said hose surrounding said interior abrasive blasting means, said container means being moveable along said hose in a fixed relationship to said interior abrasive blasting means;

e) an exterior abrasive blasting means being directed towards an exterior portion of said hose contained within said container means; and, f) means for communicating debris from said container means to said vacuum source.

2. The hose cleaning system according to claim 1 wherein said interior abrasive blasting means and said container means, in a fixed relationship with said interior abrasive blasting means, is moveable such that said interior abrasive blasting means is insertable at least halfway the entire length of said hose.

3. The hose cleaning system according to claim 2 wherein said interior abrasive blast means includes:

a) means for supplying compressed air; and, b) means for intermixing compressed air from said means for supplying compressed air with a selected abrasive media.

4. The hose cleaning system according to claim 3 wherein said selected media includes a plastic media.

5. The hose cleaning system according to claim 3 wherein said vacuum source includes means for cleaning material received from said first end of said hose.

6. The hose cleaning system according to claim 2 wherein said means for supplying compressed air and said means for intermixing simultaneously communicate with both said interior abrasive blasting means and the exterior abrasive blasting means.

7. The hose cleaning system according to claim 6 further including a first valve for controlling air-media to said interior abrasive blasting means and a second valve for controlling air-media to said exterior abrasive blasting means.

8. The hose cleaning system according to claim 7 wherein said exterior abrasive blasting means and said interior abrasive blasting means are in a fixed relationship.

9. The hose cleaning system according to claim 8 wherein said container means includes sealing means for restraining air flow exiting from said container around the circumferance of said hose.

10. A mechanism for cleaning a hose comprising:

a) a support system for holding the hose in a substantially linear relationship;

b) a vacuum source being rotatably attached to a first end of the hose;

c) rotational means for rotating the hose around its longitudinal axis;

d) container means for surrounding a portion of said hose exterior to said interior abrasive blasting means, said container means being moveable along said hose;

e) an exterior abrasive blasting means being directed towards an exterior portion of said hose contained within said container means;

f) interior abrasive blasting means being insertable into said second end of said hose, and wherein said interior abrasive blasting means is insertable at least halfway the entire length of said hose, said container means, said exterior abrasive blasting means, and said interior abrasive blasting means being in a fixed relationship; and, g) means for communicating debris from said container means to said vacuum means.

11. The mechanism according to claim 10 wherein said interior abrasive blast means includes:

a) means for supplying compressed air; and, b) means for intermixing compressed air from said means for supplying compressed air with a selected abrasive media.

12. The mechanism according to claim 11 wherein said selected media includes a plastic media.

13. The mechanism according to claim 11 wherein said vacuum source includes means for cleaning material received from said first end of said hose.

14. The mechanism according to claim 10 wherein said means for supplying compressed air and said means for intermixing simultaneously communicate with both said interior abrasive blasting means and the exterior abrasive blasting means.

15. The mechanism according to claim 14 further including a first valve for controlling air-media to said interior abrasive blasting means and a second valve for controlling air-media to said exterior abrasive blasting means.

16. The mechanism according to claim 15 wherein said exterior abrasive blasting means and said interior abrasive blasting means are in a fixed relationship.

17. The mechanism according to claim 15 wherein said container means includes sealing means for restraining air flow exiting from said container around the circumference of said hose.

18. A system for cleaning a hose comprising:

a) a support system for holding the hose in a substantially linear relationship;

b) a vacuum source being rotatably attached to a first end of the hose;

c) rotational means for rotating the hose around its longitudinal axis;

d) an abrasive blasting means having, 1) means for supplying compressed air, 2) means for intermixing compressed air from said means for supplying compressed air with a plastic media abrasive, 3) an interior abrasive blasting means being insertable into said second end of said hose, said interior abrasive blasting means being insertable at least halfway the entire length of said hose.

4) container means for surrounding a portion of said hose exterior to said interior abrasive blast means and moveable along said hose in a fixed relationship to said interior abrasive blast means, 5) an exterior abrasive blasting means being enclosed in said container means for directing an abrasive stream against an exterior portion of said hose contained within said container means, 6) means for communicating a mixture from said means for intermixing to said interior abrasive blast means and said exterior abrasive blasting means; and, e) means for communicating debris from said container means to said vacuum means.

19. The system according to claim 18 wherein said vacuum source includes means for cleaning material received from said first end of said hose.

20. The system according to claim 19 wherein said container means includes sealing means for restraining air flow exiting from said container around the circumference of said hose.

21. The system according to claim 20 wherein said exterior abrasive blasting means and said interior abrasive blasting means are in a fixed relationship.

22. The system according to claim 21 wherein said means for supplying compressed air and said means for intermixing simultaneously communicate with both said interior abrasive blasting means and the exterior abrasive blasting means.

23. The system according to claim 22 further including a first valve for controlling air-media to said interior abrasive blasting means and a second valve for controlling air-media to said exterior abrasive blasting means.

24. A method of cleaning debris from an interior portion of a hose comprising the steps of:

a) creating a flow of air from a first end of said hose to a second end of said hose;

b) simultaneously, 1) rotating said hose around its longitudinal axis, 2) inserting an interior abrasive blasting nozzle into the first end of said hose, and, 3) passing an exterior abrasive blasting nozzle enclosed in a container said container being moveable along said hose and in a fixed relationship to said interior abrasive blasting nozzle along an exterior of said hose in unison with said interior abrasive blasting nozzle; and, c) communicating debris from said container to a vacuum source.

25. The method of cleaning according to claim 24 further comprising the step, during the inserting of an abrasive blast nozzle, of separating debris from abrasive media exiting from the second end of said hose.

* * * * *